US010043398B2

(12) United States Patent
Akselrod et al.

(10) Patent No.: US 10,043,398 B2
(45) Date of Patent: Aug. 7, 2018

(54) DRONE COORDINATION

(71) Applicant: International Business Machines Corporation, Armonk, NY (US)

(72) Inventors: Ben Z. Akselrod, Givat Shmuel (IL); Anthony Di Loreto, Markham (CA); Steve McDuff, Markham (CA); Kyle D. Robeson, North York (CA)

(73) Assignee: International Business Machines Corporation, Armonk, NY (US)

( * ) Notice: Subject to any disclaimer, the term of this patent is extended or adjusted under 35 U.S.C. 154(b) by 109 days.

(21) Appl. No.: 15/080,731

(22) Filed: Mar. 25, 2016

(65) Prior Publication Data

US 2017/0278406 A1 Sep. 28, 2017

(51) Int. Cl.
*G08G 5/00* (2006.01)
*G08G 9/00* (2006.01)

(52) U.S. Cl.
CPC ..... *G08G 5/0039* (2013.01); *G08G 5/0043* (2013.01); *G08G 9/00* (2013.01)

(58) Field of Classification Search
CPC ..... G08G 5/0039; G08G 5/0043; G08G 9/00
See application file for complete search history.

(56) References Cited

U.S. PATENT DOCUMENTS 8,515,593 B2 8/2013 Marty et al.
8,838,289 B2 9/2014 Margolin
9,412,278 B1 * 8/2016 Gong ..... H04L 63/101
9,704,409 B2 * 7/2017 Prakash ..... B64C 39/024
9,792,613 B2 * 10/2017 Gong ..... G06Q 30/018
9,805,372 B2 * 10/2017 Gong ..... B64C 39/024
9,805,607 B2 * 10/2017 Gong ..... G08G 5/006
9,807,451 B2 10/2017 Xu et al.
9,870,566 B2 * 1/2018 Gong ..... G08G 5/0086
2015/0367956 A1 * 12/2015 Loussides ..... B64D 45/04 701/11
2016/0196756 A1 * 7/2016 Prakash ..... B64C 39/024 701/3

(Continued)

FOREIGN PATENT DOCUMENTS

CN 101837835 A 9/2010
CN 202694592 U 1/2013

(Continued)

OTHER PUBLICATIONS

Debusk et al., "Unmanned Aerial Vehicle Systems for Disaster Relief: Tornado Alley", NASA Scientific and Technical Information Program, Apr. 6, 2009, pp. 1-10.

(Continued)

*Primary Examiner* — Frederick M Brushaber
(74) *Attorney, Agent, or Firm* — Scully, Scott, Murphy & Presser, P.C.; Michael O'Keefe, Esq.

(57) ABSTRACT

A system for drone coordination includes logic to detect an adverse weather condition and detect a plurality of drones operating in a region to be affected by the adverse weather condition. The logic can also transmit a request to the plurality of drones, wherein the request indicates that each of the plurality of drones is to return to an emergency landing site to be selected from a set of predetermined emergency landing sites. The emergency landing site for each drone can be based in part on the location of the drone at the time of transmittal of the request.

18 Claims, 5 Drawing Sheets

(56) References Cited

U.S. PATENT DOCUMENTS

| | | | | |
|---|---|---|---|---|
| 2016/0225264 | A1* | 8/2016 | Taveira | B64C 39/024 |
| 2016/0300187 | A1* | 10/2016 | Kashi | G06Q 10/0836 |
| 2017/0045894 | A1* | 2/2017 | Canoy | G05D 1/101 |
| 2017/0090484 | A1* | 3/2017 | Obaidi | G05D 1/104 |
| 2017/0158327 | A1* | 6/2017 | Willford | B64C 25/34 |
| 2017/0169713 | A1* | 6/2017 | Gong | G08G 5/006 |
| 2017/0278406 | A1* | 9/2017 | Akselrod | G08G 5/0039 |

FOREIGN PATENT DOCUMENTS

| | | | |
|---|---|---|---|
| EP | 2749984 | A2 | 7/2014 |
| WO | 2014106268 | A1 | 7/2014 |
| WO | 2015101848 | A2 | 7/2015 |

OTHER PUBLICATIONS

Pomerleau, "NASA building air-traffic control for low-flying drones", https://gcn.com/articles/2015/06/25/nasa-drone-detection.aspx, Jun. 25, 2015, pp. 1-4.

* cited by examiner

100

200

DRONE COORDINATION

BACKGROUND

The present disclosure relates to drones, and more specifically, but not exclusively, to coordinating drone flight paths in the event of an adverse weather condition.

SUMMARY

According to an embodiment described herein, a system for drone coordination can include logic to detect an adverse weather condition and detect a plurality of drones operating in a region to be affected by the adverse weather condition. The logic can also transmit a request to the plurality of drones, wherein the request indicates that each of the plurality of drones is to return to an emergency landing site to be selected from a set of predetermined emergency landing sites, and wherein the emergency landing site for each drone is to be based in part on the location of the drone at the time of transmittal of the request.

According to another embodiment, a method for coordinating drones comprises detecting an adverse weather condition and detecting a plurality of drones operating in a region to be affected by the adverse weather condition. The method can also include transmitting a request to the plurality of drones, wherein the request indicates that each of the plurality of drones is to return to an emergency landing site to be selected from a set of predetermined emergency landing sites, and wherein the emergency landing site for each drone is based in part on the location of the drone at the time of transmittal of the request and a priority value corresponding to each drone.

According to another embodiment, a computer program product for drone coordination can include a computer readable storage medium having program instructions embodied therewith, wherein the computer readable storage medium is not a transitory signal per se. The program instructions can be executable by a processor to cause the processor to detect an adverse weather condition and detect a plurality of drones operating in a region to be affected by the adverse weather condition. The program instructions can also be executable by a processor to cause the processor to modify operation of the plurality of drones by transmitting a request to each of the drones, wherein the request indicates that each of the drones is to return to an emergency landing site to be selected from a set of predetermined emergency landing sites, the emergency landing site for each drone to be based in part on the location of the drone at the time of transmittal of the request, a first priority value corresponding to the drone, and a second priority value corresponding to the emergency landing site

DETAILED DESCRIPTION

As the number of drones in operation increases, weather conditions pose a greater threat to the safety of the drones. For example, strong cross winds, extreme temperatures, and high waves can result in conditions in which drones cannot safely operate. Returning the drones to safe locations before encountering such adverse weather conditions can prevent damage to the drones.

The embodiments described herein include techniques for drone coordination that can include detecting an adverse weather condition and detecting any number of drones operating in a region to be affected by the adverse weather condition. A drone, as referred to herein, can include autonomous aircraft, autonomous watercraft, or autonomous vehicles, among others. In some examples, the drones can be manned or unmanned. In some embodiments, a system can detect any suitable number of drones operating in a region, which may or may not be located close to the system. Therefore, the system described herein can coordinate drones remotely from any suitable distance. In some examples, the drones can be registered with the system by providing information such as the type of the drone, the manufacturer, communication abilities, supported wireless protocols, and the like. The information provided by the drones to the system during registration can enable the system to transmit data, such as coordinates of an emergency landing site, to the drones in response to detecting an adverse weather condition.

In some embodiments, a system can transmit a request to a plurality of drones, wherein the request indicates that each of the plurality of drones is to return to an emergency landing site. In some embodiments, the emergency landing site for each drone can be based in part on the location of the drone at the time of transmittal of the request. For example, the system can detect any suitable number of predetermined emergency landing sites between a launch site for the drone and a landing site for the drone at the end of a flight path. If the system detects an adverse weather condition as the drone is traveling along the flight path, the system can indicate to the drone to land at an emergency landing site rather than traveling to the end of the flight path. In some examples, the system can determine the emergency landing site for the drone based on any number of conditions such as the location of the drone at the time the system detects the adverse weather condition, a number of drones landing at an emergency landing site within a period of time, the type of emergency landing site, and the security at the emergency landing site, among others. Therefore, the system can prevent damage to drones by transmitting instructions to the drones to land prior to experiencing adverse weather conditions that could damage the drones and any goods which the drones may be transporting.

Figure 1:
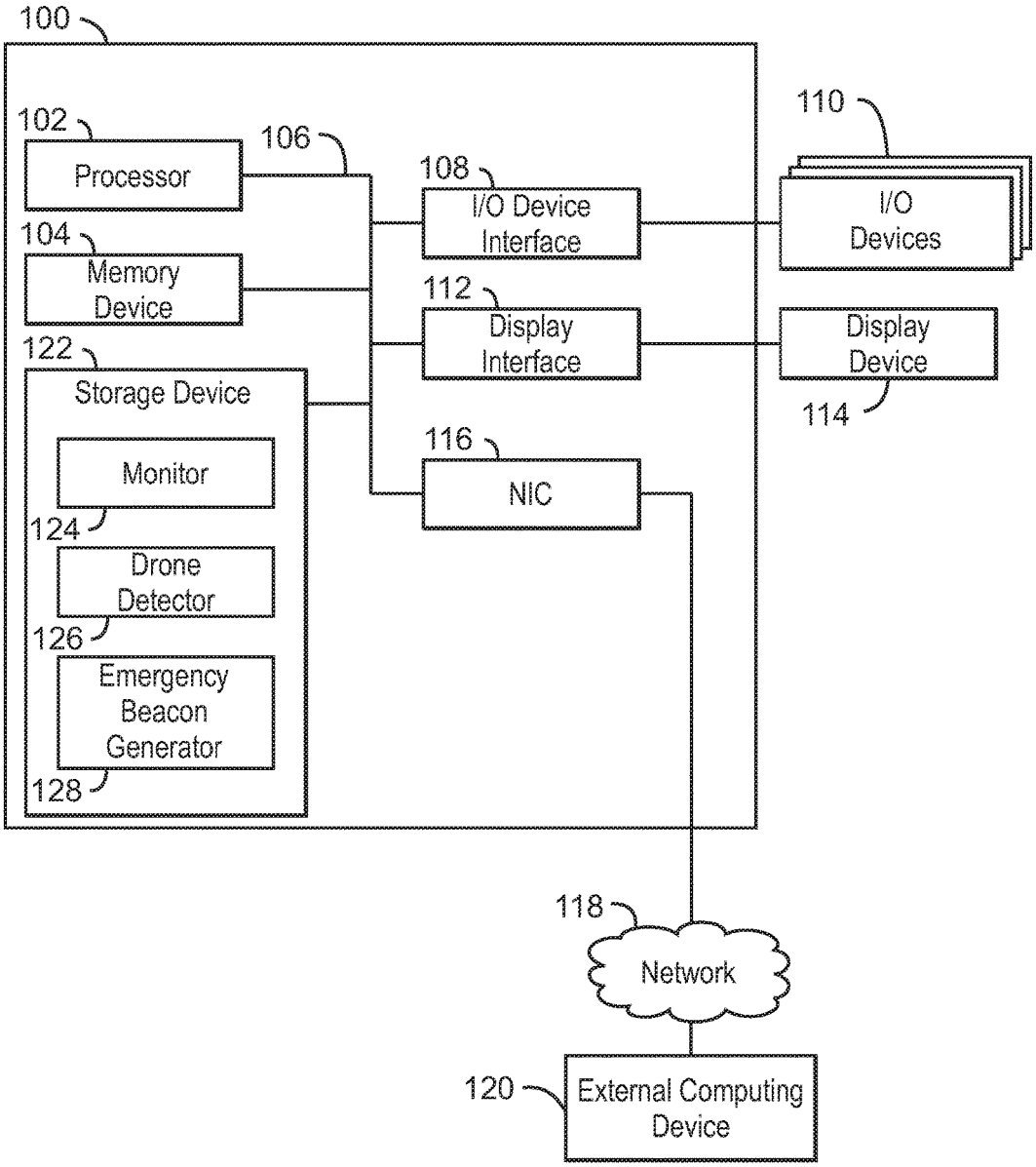
FIG. 1 depicts a block diagram of an example computing system that can coordinate drones according to an embodiment described herein.

With reference now to FIG. 1, an example computing device is depicted that can coordinate drones. The computing device 100 may be for example, a server, desktop computer, laptop computer, tablet computer, or smartphone. In some examples, computing device 100 may be a cloud computing node. Computing device 100 may be described in the general context of computer system executable instructions, such as program modules, being executed by a computer system. Generally, program modules may include routines, programs, objects, components, logic, data structures, and so on that perform particular tasks or implement particular abstract data types. Computing device 100 may be practiced in distributed cloud computing environments where tasks are performed by remote processing devices that are linked through a communications network. In a distributed cloud computing environment, program modules may be located in both local and remote computer system storage media including memory storage devices.

The computing device 100 may include a processor 102 that is adapted to execute stored instructions, a memory device 104 to provide temporary memory space for operations of said instructions during operation. The processor can be a single-core processor, multi-core processor, computing cluster, or any number of other configurations. The memory 104 can include random access memory (RAM), read only memory, flash memory, or any other suitable memory systems.

The processor 102 may be connected through a system interconnect 106 (e.g., PCI®, PCI-Express®, etc.) to an input/output (I/O) device interface 108 adapted to connect the computing device 100 to one or more I/O devices 110. The I/O devices 110 may include, for example, a keyboard and a pointing device, wherein the pointing device may include a touchpad or a touchscreen, among others. The I/O devices 110 may be built-in components of the computing device 100, or may be devices that are externally connected to the computing device 100.

The processor 102 may also be linked through the system interconnect 106 to a display interface 112 adapted to connect the computing device 100 to a display device 114. The display device 114 may include a display screen that is a built-in component of the computing device 100. The display device 114 may also include a computer monitor, television, or projector, among others, that is externally connected to the computing device 100. In addition, a network interface controller (NIC) 116 may be adapted to connect the computing device 100 through the system interconnect 106 to the network 118. In some embodiments, the NIC 116 can transmit data using any suitable interface or protocol, such as the internet small computer system interface, among others. The network 118 may be a cellular network, a radio network, a wide area network (WAN), a local area network (LAN), or the Internet, among others. An external computing device 120 may connect to the computing device 100 through the network 118. In some examples, external computing device 120 may be an external webserver 120. In some examples, external computing device 120 may be a cloud computing node.

The processor 102 may also be linked through the system interconnect 106 to a storage device 122 that can include a hard drive, an optical drive, a USB flash drive, an array of drives, or any combinations thereof. In some examples, the storage device may include a monitor 124, a drone detector 126, and an emergency beacon generator 128. The monitor 124 can continuously track weather conditions in a region based on any number of weather input values. For example, the monitor 124 can gather weather information from any number of sensors and websites, among others, and aggregate the weather information to detect an adverse weather condition. In some examples, an adverse weather condition can include wind speeds or cross wind speeds that exceed a predetermined threshold, cold or hot temperatures that exceed a predetermined threshold, ice accumulation, wave height, hail size, and rain velocity, among others.

In some embodiments, the drone detector 126 can detect a plurality of drones operating in a region to be affected by the adverse weather condition. For example, the drone detector 126 can detect any number of drones in a region based on information transmitted to the drone detector 126 from registered drones, or drones detected by radar, among other techniques. The drone detector 126 can determine which portions of the region may be affected by the adverse weather condition and determine which drones are in operation along flight paths that are likely to encounter the adverse weather condition.

In some embodiments, the emergency beacon generator 128 can transmit a request to the plurality of drones, wherein the request indicates that each of the plurality of drones is to return to an emergency landing site. In some examples, the emergency landing site for each drone can be based in part on the location of the drone at the time of transmittal of the request. For example, the emergency beacon generator 128 can transmit a new flight path or new coordinates corresponding to an emergency landing site that the drone can reach without encountering an adverse weather condition. In some examples, the emergency landing site is selected from a set of predetermined emergency landing sites along a flight path.

It is to be understood that the block diagram of FIG. 1 is not intended to indicate that the computing device 100 is to include all of the components shown in FIG. 1. Rather, the computing device 100 can include fewer or additional components not illustrated in FIG. 1 (e.g., additional memory components, embedded controllers, modules, additional network interfaces, etc.). Furthermore, any of the functionalities of the monitor 124, drone detector 126, and emergency beacon generator 128 may be partially, or entirely, implemented in hardware and/or in the processor 102. For example, the functionality may be implemented with an application specific integrated circuit, logic implemented in an embedded controller, or in logic implemented in the processor 102, among others. In some embodiments, the functionalities of the monitor 124, drone detector 126, and emergency beacon generator 128, can be implemented with logic, wherein the logic, as referred to herein, can include any suitable hardware (e.g., a processor, among others), software (e.g., an application, among others), firmware, or any suitable combination of hardware, software, and firmware.

Figure 2:
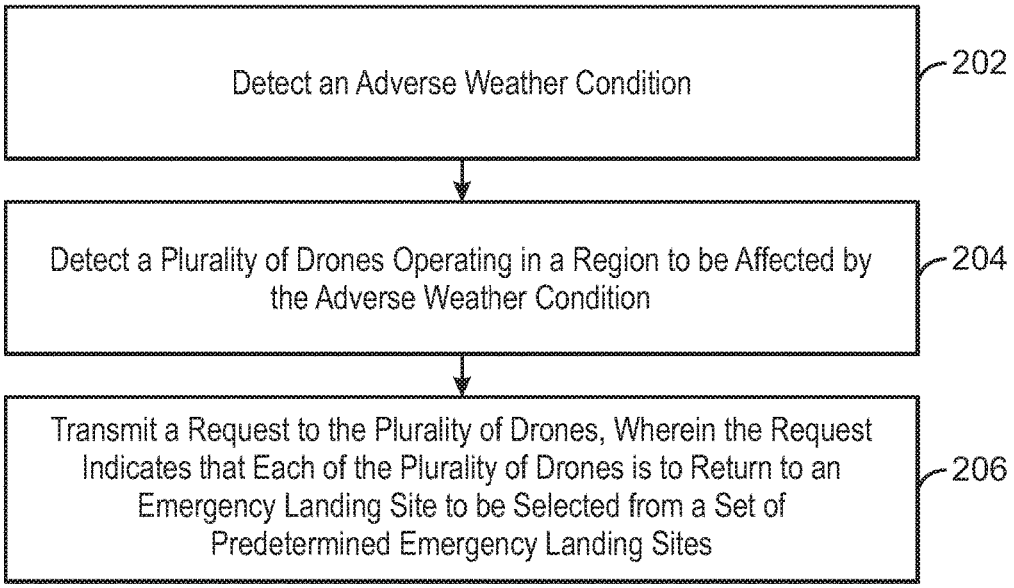
FIG. 2 is a process flow diagram of an example method that can coordinate drones according to an embodiment described herein.

FIG. 2 is a process flow diagram of an example method that can coordinate drones. The method 200 can be implemented with any suitable computing device, such as the computing device 100 of FIG. 1.

At block 202, a monitor 124 can detect an adverse weather condition. In some examples, as discussed above, an adverse weather condition can include wind speeds or cross wind speeds that exceed a predetermined threshold, cold or hot temperatures that exceed a predetermined threshold, ice accumulation, wave height, hail size, and rain velocity, among others. The monitor 124 can detect the adverse weather condition based on actual weather conditions in a region or a forecast of weather conditions to affect a region. In some examples, the monitor 124 can detect the actual weather conditions or a forecast of weather conditions from any suitable source, such as a website, sensors, and the like.

At block 204, a drone detector 126 can detect a plurality of drones operating in a region to be affected by the adverse weather condition. A drone, as referred to herein, can include any autonomous aircraft, autonomous watercraft, or autonomous vehicle, among others. In some embodiments, the drones can operate along hops or a series of flight paths. The drone detector 126 can detect a particular hop or flight path that may be affected by the adverse weather condition.

In some embodiments, the drone detector 126 can collect characteristics for a plurality of drones prior to operation of the drones. In some examples, collecting the characteristics for each drone can be included in a registration process. The characteristics for each drone can include a type of the drone, manufacturer of the drone, maximum operating altitude, maximum operating wind speed, maximum or minimum operating temperature, landing requirements, maximum wave heights, and the like. In some examples, the characteristics for each drone can indicate whether a drone can land vertically or horizontally. The characteristics for the drone can also correspond to cargo that the drone is transporting. For example, the characteristics of the drone can indicate a value of cargo to be transported, a minimum security level for a landing site, and the like. In some examples, the drone detector 126 can determine if a drone will be affected by an adverse weather condition based on the characteristics of the drone. For example, a cross wind speed may exceed the operational capability of smaller drones, while larger drones may be able to continue operation in such conditions. Thus, the drone detector 126 can independently determine which drones operating in a region may be affected by weather conditions.

At block 206, an emergency beacon generator 128 can transmit a request to the plurality of drones, wherein the request indicates that each of the plurality of drones is to return to an emergency landing site to be selected from a set of predetermined emergency landing sites. The emergency beacon generator 128 can transmit the request based on characteristics of the drone determined during a registration process. For example, the emergency beacon generator 128 can transmit the request to a drone using any suitable wireless protocol, or radio frequency, among others, that is supported by the drone. In some embodiments, the request can be transmitted from the emergency beacon generator 128 to the drone in an encrypted format. For example, the emergency beacon generator 128 can use encryption keys, and other encryption techniques, established during the registration process to transmit the request. The request can override any previous instructions provided to the drone or any subsequent instructions. For example, the request can override instructions that indicate a landing site previously identified as the end of the flight path. The request can also override instructions transmitted to the drone by an operator subsequent to the transmittal of the request. For example, the request can prevent an operator from instructing a drone to continue travelling along a flight path that will encounter an adverse weather condition. In some embodiments, the emergency beacon generator 128 can send a request to a drone of an unknown type and allow the drone to determine if the adverse weather condition exceeds operating capabilities of the drone.

In some embodiments, the emergency landing site selected for each drone can be based in part on the location of the drone at the time of transmittal of the request. For example, the emergency beacon generator 128 can provide a request to a drone to land at the closest emergency landing site when an adverse weather condition is detected. In some examples, the closest emergency landing site is selected from a set of predetermined emergency landing sites.

In some embodiments, the emergency beacon generator 128 can calculate a flight path from a location of each drone to the selected emergency landing site corresponding to each drone and transmit the flight path to the each drone. In some examples, the emergency beacon generator 128 can modify the calculated flight paths from the locations of at least two drones to emergency landing sites based in part on collision avoidance data and transmit the modified flight paths to the at least two drones. For example, the emergency beacon generator 128 can determine when two or more drones may attempt to land at one emergency landing site, which may result in a collision of the drones. The emergency beacon generator 128 can modify the flight path by modifying the speed or arrival time of the drones, modifying the trajectory of the flight path, and the like. In some examples, the flight path can be based in part on a priority value for each drone and a priority value for each landing site. The priority value for each drone can be based in part on a battery level, cargo value, or drone size, among others. Additionally, the priority value for each landing site can be based in part on a security level of the landing site, condition of the landing site, or proximity of the landing site, among others. The emergency beacon coordinator 128 can determine the appropriate flight path and emergency landing site for each drone based on any suitable combination of the priority values for the drones and emergency landing sites. In some embodiments, each of the priority values can be calculated based on a weighted average of characteristics such as battery size, value of cargo, security of a landing site, and proximity of emergency landing site to populated areas, among others. In some examples, the emergency beacon coordinator 128 can calculate the priority values with any suitable mathematical technique such as arithmetic mean, weighted arithmetic mean, regression analysis, and the like.

The emergency beacon generator 128, still at block 206, can also determine a landing site is at capacity, detect a priority value of a drone is below a threshold value and transmit a signal to the drone to land immediately. For example, the emergency beacon generator 128 can determine that a drone is a lower priority than other drones in operation and that emergency landing sites cannot accommodate the lower priority drone. Thus, in some circumstances, the request to the lower priority drones can indicate to the drone to land immediately, continue on the original flight path, or calculate a new landing site. By prioritizing the drones, the emergency beacon generator 128 can prevent damage to drones with a priority value above a threshold, but the lower priority drones may experience damage.

The process flow diagram of FIG. 2 is not intended to indicate that the operations of the method 200 are to be executed in any particular order, or that all of the operations of the method 200 are to be included in every case. Additionally, the method 200 can include any suitable number of additional operations. For example, the emergency beacon generator 128 can transmit a warning to non-operational drones in the region to wait for a predetermined period of time before operating the non-operational drones. In some embodiments, the predetermined period of time can correspond to a length of time for the adverse weather condition to subside in the region. Alternatively, the emergency beacon generator 128 can transmit a warning to non-operational drones in the region to wait for an approval signal before operating the non-operational drones.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical functions. In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 3:
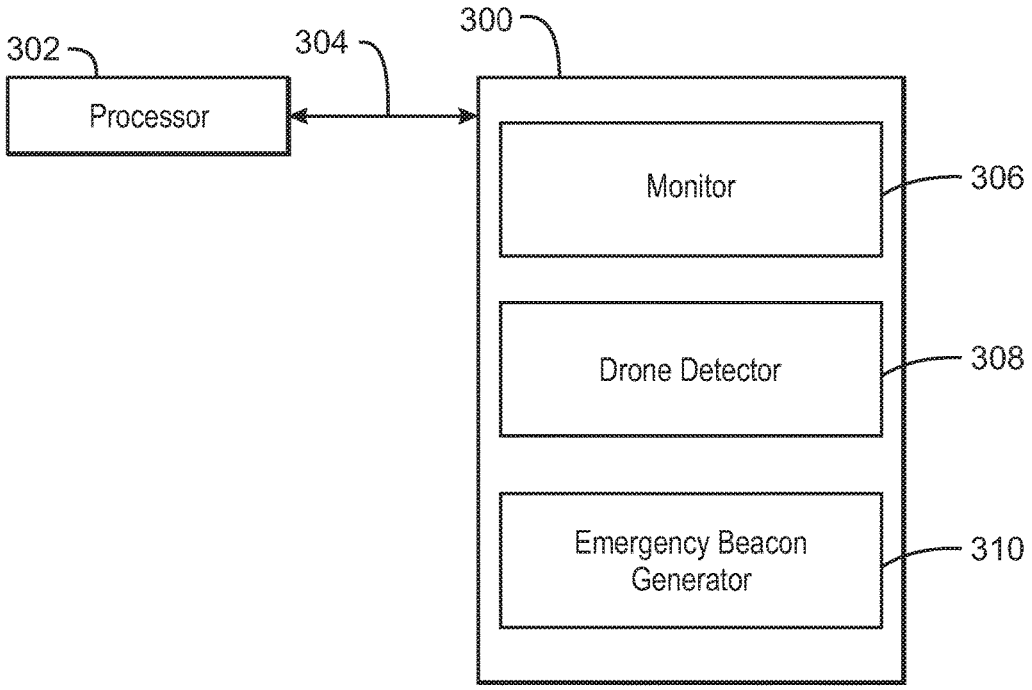
FIG. 3 is a tangible, non-transitory computer-readable medium that can coordinate drones according to an embodiment described herein.

Referring now to FIG. 3, a block diagram is depicted of an example of a tangible, non-transitory computer-readable medium that can coordinate drones. The tangible, non-transitory, computer-readable medium 300 may be accessed by a processor 302 over a computer interconnect 304. Furthermore, the tangible, non-transitory, computer-readable medium 300 may include code to direct the processor 302 to perform the operations of the current method.

The various software components discussed herein may be stored on the tangible, non-transitory, computer-readable medium 300, as indicated in FIG. 3. For example, a monitor 306 can detect an adverse weather condition. In some examples, a drone detector 308 can detect a plurality of drones operating in a region to be affected by the adverse weather condition. Furthermore, an emergency beacon generator 310 can transmit a request to the plurality of drones, wherein the request indicates that each of the plurality of drones is to return to an emergency landing site to be selected from a set of predetermined emergency landing sites and the selected emergency landing site for each drone is based in part on the location of the drone at the time of transmittal of the request.

It is to be understood that any number of additional software components not shown in FIG. 3 may be included within the tangible, non-transitory, computer-readable medium 300, depending on the specific application. Furthermore, fewer software components than those shown in FIG. 3 can be included in the tangible, non-transitory, computer-readable medium 300.

Figure 4:
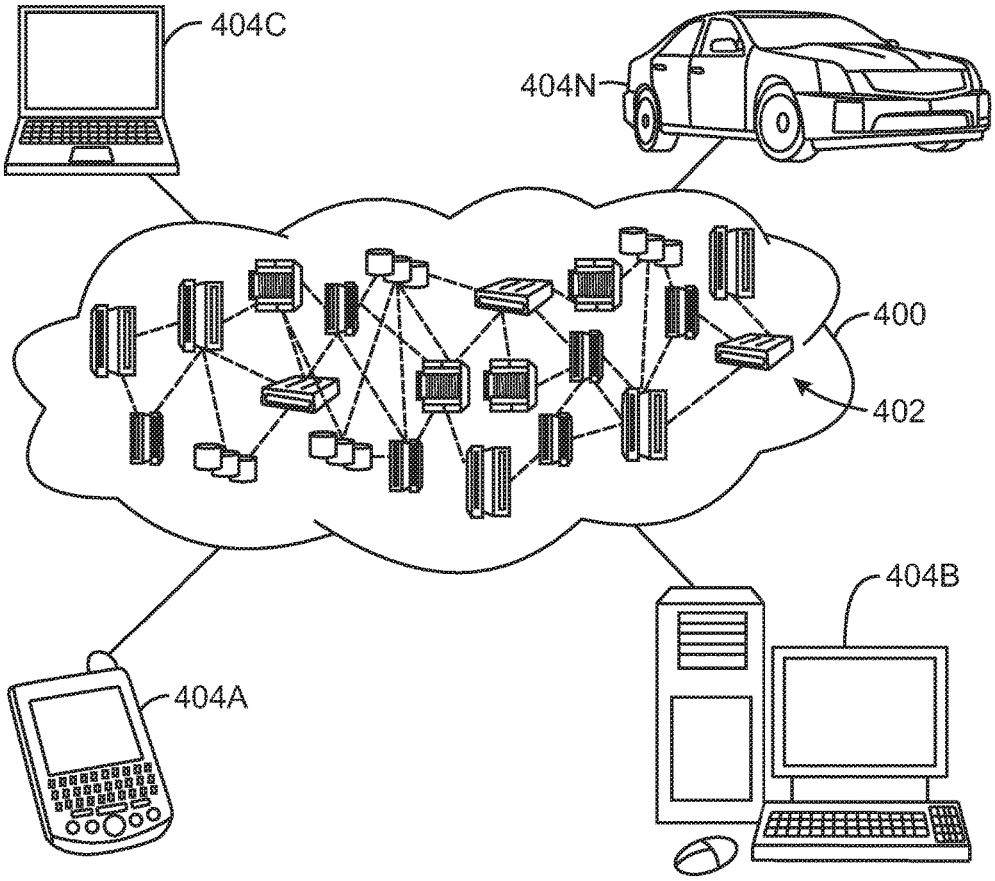
FIG. 4 depicts an illustrative cloud computing environment according to an embodiment described herein.

Referring now to FIG. 4, illustrative cloud computing environment 400 is depicted. As shown, cloud computing environment 400 comprises one or more cloud computing nodes 402 with which local computing devices used by cloud consumers, such as, for example, personal digital assistant (PDA) or cellular telephone 404A, desktop computer 404B, laptop computer 404C, and/or automobile computer system 404N may communicate. Nodes 402 may communicate with one another. They may be grouped (not shown) physically or virtually, in one or more networks, such as Private, Community, Public, or Hybrid clouds as described hereinabove, or a combination thereof. This allows cloud computing environment 400 to offer infrastructure, platforms and/or software as services for which a cloud consumer does not need to maintain resources on a local computing device. It is understood that the types of computing devices 404A-N shown in FIG. 4 are intended to be illustrative only and that computing nodes 402 and cloud computing environment 400 can communicate with any type of computerized device over any type of network and/or network addressable connection (e.g., using a web browser).

Figure 5:
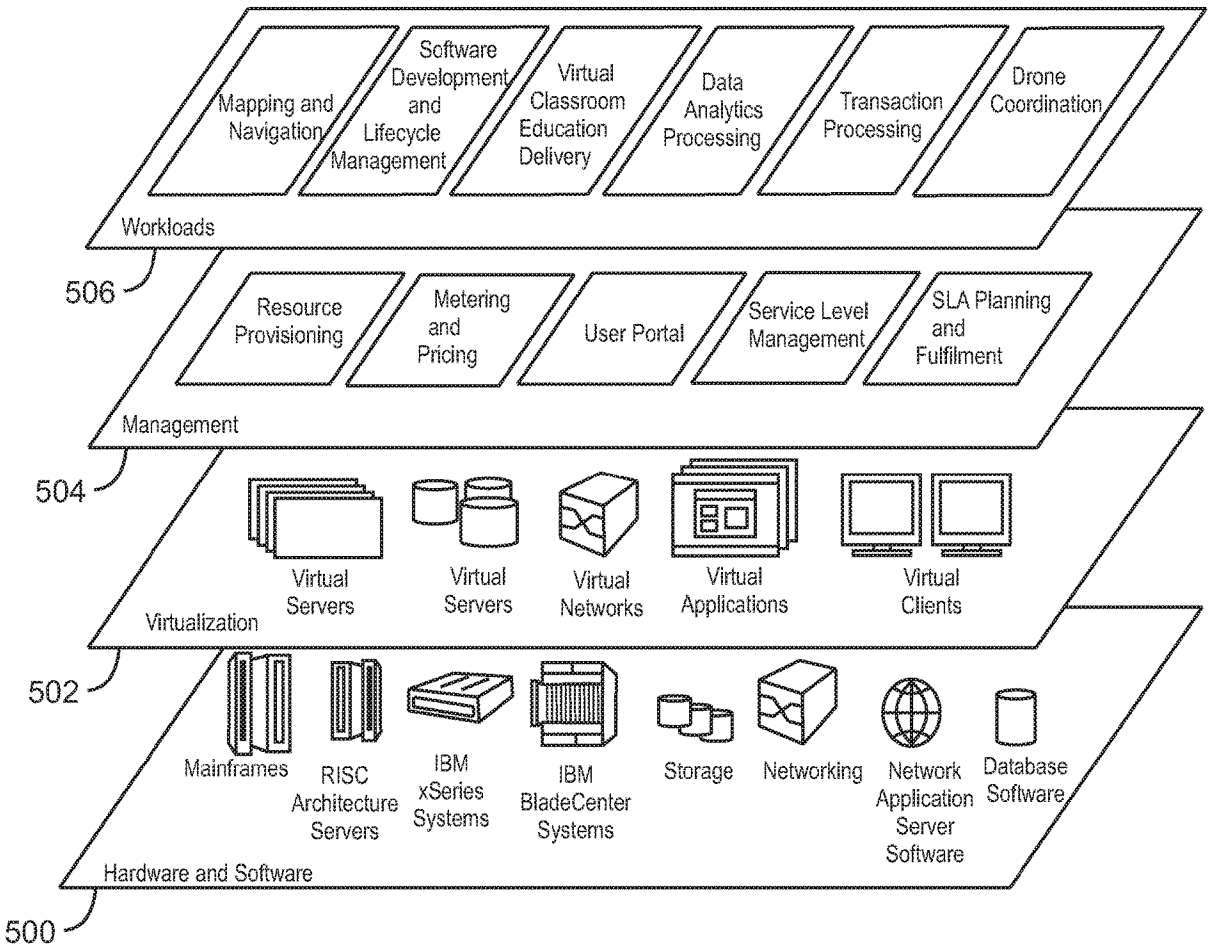
FIG. 5 depicts a set of functional abstraction layers provided by a cloud computing environment according to an embodiment described herein.

Referring now to FIG. 5, a set of functional abstraction layers provided by cloud computing environment 400 (FIG. 4) is shown. It should be understood in advance that the components, layers, and functions shown in FIG. 5 are intended to be illustrative only and embodiments of the invention are not limited thereto. As depicted, the following layers and corresponding functions are provided.

Hardware and software layer 500 includes hardware and software components. Examples of hardware components include mainframes, in one example IBM® zSeries® systems; RISC (Reduced Instruction Set Computer) architecture based servers, in one example IBM pSeries® systems; IBM xSeries® systems; IBM BladeCenter® systems; storage devices; networks and networking components. Examples of software components include network application server software, in one example IBM WebSphere® application server software; and database software, in one example IBM DB2® database software. (IBM, zSeries, pSeries, xSeries, BladeCenter, WebSphere, and DB2 are trademarks of International Business Machines Corporation registered in many jurisdictions worldwide).

Virtualization layer 502 provides an abstraction layer from which the following examples of virtual entities may be provided: virtual servers; virtual storage; virtual networks, including virtual private networks; virtual applications and operating systems; and virtual clients. In one example, management layer 504 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide pre-arrangement for, and procurement of, cloud computing resources for which a future requirement is anticipated in accordance with an SLA.

Workloads layer 506 provides examples of functionality for which the cloud computing environment may be utilized. Examples of workloads and functions which may be provided from this layer include: mapping and navigation; software development and lifecycle management; virtual classroom education delivery; data analytics processing; transaction processing; and drone coordination.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer system for coordinating unmanned aerial vehicles (UAVs) comprising:

a memory storage device storing programming instructions;

a hardware processor, receiving said programming instructions to configure said computer system to:

detect an adverse weather condition;

detect a plurality of UAVs operating in a region to be affected by the adverse weather condition;

generate a communications signal according to a wireless communication protocol;

transmit the communications signal to each of the plurality of UAVs, the signal instructing that each UAV is to return to an emergency landing site to be selected from a set of predetermined emergency landing sites, the emergency landing site for each UAV based on a current location of the UAV at the time of transmittal of the request; and said hardware processor being further configured to:

determine the emergency landing site is at capacity;

detect a priority value of a UAV is below a threshold value; and control the UAV to land immediately.

2. The system of claim 1, wherein the hardware processor is further configured to transmit a warning to non-operational UAVs in the region to wait for a predetermined period of time before operating the non-operational UAVs.

3. The system of claim 2, wherein the predetermined period of time corresponds to a length of time for the adverse weather condition to subside in the region.

4. The system of claim 1, wherein the hardware processor is further configured to transmit a warning to non-operational UAVs in the region to wait for an approval signal before operating the non-operational UAVs.

5. The system of claim 1, wherein the logic is to:

calculate a flight path from a location of each UAV to the emergency landing site corresponding to each UAV; and transmit the flight path to the each UAV.

6. The system of claim 5, wherein the flight path is based in part on a priority value for each UAV and a priority value for each landing site.

7. The system of claim 6, wherein the priority value for each UAV is based in part on a battery level, cargo value, or UAV size.

8. The system of claim 6, wherein the priority value for each emergency landing site is based in part on a security level of the landing site, condition of the landing site, or proximity of the landing site.

9. The system of claim 1, wherein the hardware processor is further configured to modify the calculated flight paths from the locations of at least two UAVs to emergency landing sites based in part on collision avoidance data; and transmit the modified flight paths to the at least two UAVs.

10. The system of claim 1, wherein characteristics of the plurality of UAVs are registered before operation of the plurality of UAVs.

11. The system of claim 1, wherein the UAVs travel by air, water, or land.

12. A computer-implemented method for coordinating unmanned aerial vehicles (UAVs) comprising:

detecting, using a hardware processor, an adverse weather condition;

detecting, using the hardware processor, a plurality of UAVs operating in a region to be affected by the adverse weather condition;

generating, using the hardware processor, a communications signal according to a wireless communication protocol;

transmitting, using the hardware processor, the communications signal to each of the plurality of UAVs, the signal instructing that each UAV is to return to an emergency landing site to be selected from a set of predetermined emergency landing sites, the emergency landing site for each UAV based on a current location of the UAV at the time of transmittal of the request and a priority value corresponding to each UAV; and determining, using the hardware processor, that the emergency landing site is at capacity;

detecting, using the hardware processor, the priority value of a UAV is below a threshold value; and controlling the UAV to land immediately.

13. The method of claim 12, comprising transmitting a warning to non-operational UAVs in the region to wait for a predetermined period of time before operating the non-operational UAVs.

14. The method of claim 13, wherein the predetermined period of time corresponds to a length of time for the adverse weather condition to subside in the region.

15. The method of claim 12, comprising transmitting a warning to non-operational UAVs in the region to wait for an approval signal before operating the non-operational UAVs.

16. The method of claim 12, comprising:

calculating a flight path from a location of each UAV to the emergency landing site corresponding to each UAV; and transmitting the flight path to the each UAV.

17. A computer program product for coordinating unmanned aerial vehicles (UAVs), the computer program product comprising a computer readable storage medium having program instructions embodied therewith, wherein the computer readable storage medium is not a transitory signal per se, the program instructions executable by a processor to cause the processor to:

detect an adverse weather condition;

detect a plurality of UAVs operating in a region to be affected by the adverse weather condition;

generate a communications signal according to a wireless communication protocol;

modify operation of the plurality of UAVs by transmitting the communications signal to each of the UAVs, the signal instructing that each UAV is to return to an emergency landing site to be selected from a set of predetermined emergency landing sites, the emergency landing site for each UAV based on the location of the UAV at the time of transmittal of the request, a first priority value corresponding to the drone, and a second priority value corresponding to the emergency landing site; wherein the program instructions further cause the processor to:

determine the emergency landing site is at capacity;

detect the first priority value of the UAV is below a threshold value; and control the UAV to land immediately.

18. The computer program product of claim 17, wherein the UAVs travel by air, water, or land.

* * * * *